US010459389B2

(12) United States Patent
Fujii

(10) Patent No.: US 10,459,389 B2
(45) Date of Patent: Oct. 29, 2019

(54) IMAGE FORMING APPARATUS

(71) Applicant: Konica Minolta, Inc., Chiyoda-ku, Tokyo (JP)

(72) Inventor: Ryosuke Fujii, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/252,347

(22) Filed: Jan. 18, 2019

(65) Prior Publication Data

US 2019/0278209 A1 Sep. 12, 2019

(30) Foreign Application Priority Data

Mar. 12, 2018 (JP) ..... 2018-043870

(51) Int. Cl.
*G03G 15/00* (2006.01)

(52) U.S. Cl.
CPC . *G03G 15/5029* (2013.01); *G03G 2215/0059* (2013.01)

(58) Field of Classification Search
CPC . G03G 2215/0059; G03G 2215/00586; G03G 2215/0436; G03G 2215/00721
See application file for complete search history.

(56) References Cited

U.S. PATENT DOCUMENTS 8,553,280 B2 * 10/2013 Hoover ..... H04N 1/506 347/116
9,965,707 B2 * 5/2018 Tanaka ..... G06F 3/1206
2003/0043256 A1 * 3/2003 Conrow ..... H04N 1/00031 347/248
2005/0207762 A1 * 9/2005 Funabiki ..... G03G 15/5062 399/15
2010/0225932 A1 * 9/2010 Kurose ..... G03G 15/0131 358/1.1
2013/0050320 A1 * 2/2013 Duke ..... B41J 3/60 347/14
2013/0155428 A1 * 6/2013 Mizuno ..... G06K 15/02 358/1.9
2017/0131671 A1 * 5/2017 Nishimura ..... G03G 15/5062

FOREIGN PATENT DOCUMENTS

JP 2007-003714 1/2007
JP 2013-151353 8/2013

* cited by examiner

*Primary Examiner* — Sevan A Aydin
(74) *Attorney, Agent, or Firm* — Squire Patton Boggs (US) LLC

(57) ABSTRACT

Conventionally, it has been impossible to adjust a transportation direction magnification correspondingly to jobs, causing an image to be formed in an unintended size, while the transportation direction magnification for the image formed on the sheet varies with jobs. A controller included in an image forming apparatus selects an image adjustment chart used to adjust a transportation direction magnification that varies with job conditions of a job to be executed currently in a transportation direction of images transferred to sheets by a transferrer. The controller adjusts the transportation direction magnification for images formed by an image former based on the image adjustment chart formed on a sheet by the image former.

12 Claims, 11 Drawing Sheets

FIRST EXAMPLE OF EXISTING CHART

SECOND EXAMPLE OF EXISTING CHART

THIRD EXAMPLE OF EXISTING CHART

FIG. 7
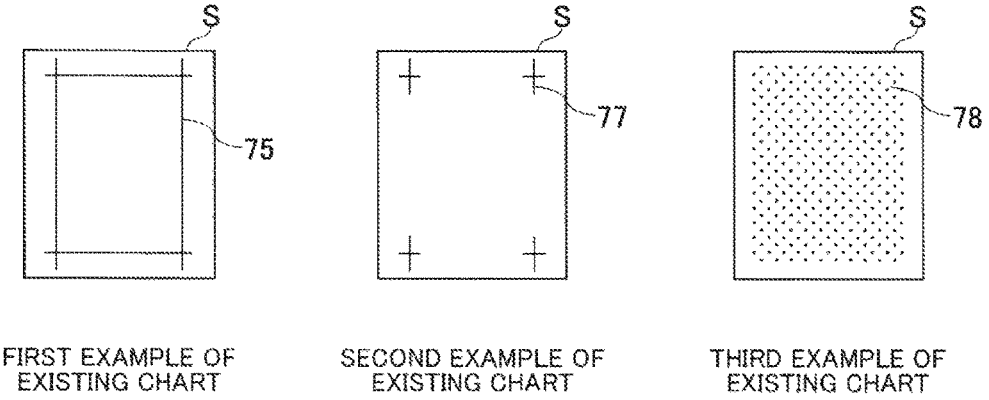
FIG. 8
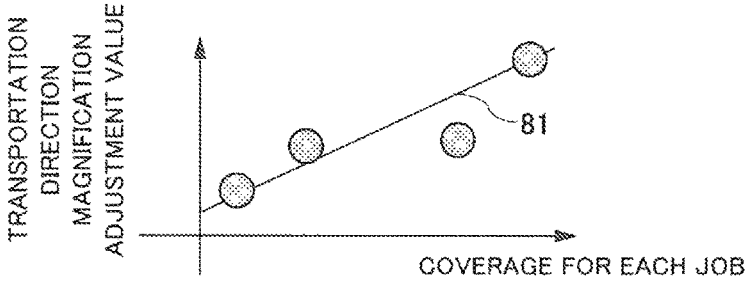
FIG. 9
36a
| COVERAGE | TRANSPORTATION DIRECTION MAGNIFICATION ADJUSTMENT VALUE |
|---|---|
36b
| JOB ID | JOB CONDITION | TRANSPORTATION DIRECTION MAGNIFICATION ADJUSTMENT VALUE |
|---|---|---|

IMAGE FORMING APPARATUS

CROSS-REFERENCE TO RELATED APPLICATIONS

The entire disclosure of Japanese Patent Application No. 2018-43870, filed on Mar. 12, 2018, is incorporated herein by reference in its entirety.

BACKGROUND

Technological Field

The present invention relates to an image forming apparatus.

Description of the Related Art

Generally, a fuser included in an image forming apparatus for the electrophotographic system fuses an image onto a sheet by applying heat and pressure to the sheet where a toner image is formed. The fuser performs fusing by placing a sheet formed with an image in between a pair of fusing rollers including a heating roller and a pressure roller.

When the fuser heats and pressurizes the sheet and fuses the image transferred onto the sheet surface, the sheet temporarily swells. The image is transferred to the reverse of the swelled sheet to fuse the image onto the sheet. The sheet is thereafter ejected and is cooled with the lapse of time. The sheet, when cooled, shrinks and causes a difference in sizes between the image fused onto the surface and the image fused onto the reverse at the same position. The technologies disclosed in Patent Literature 1 and Patent Literature 2 are provided to prevent a change in the image fused onto the sheet.

Patent Literature 1 discloses the technology that estimates the stretch of an intermediate transfer belt depending on sheet types, adjusts the pressure of a belt tension roller, and adjusts the longitudinal magnification of an image formed on the sheet.

Patent Literature 2 discloses the technology that controls the timing to press and detach preceding and succeeding rollers to prevent slippage on even a transferrer having a small conveying force and suppresses variations in the longitudinal magnification of images.

CITATION LIST

Patent Literature

Patent Literature 1: JP 2007-3714 A
Patent Literature 2: JP 2013-151353 A

SUMMARY

An image transferred by the transferrer to the sheet may be subject to a change in the magnification in the transportation direction along which a transporter in the image forming apparatus transports the sheet. The magnification of an image in the transportation direction is referred to as "transportation direction magnification." It is known that the transportation direction magnification varies with job conditions settled for each job input to the image forming apparatus. The job execution is preceded by a work that adjusts the position of an image formed on the sheet by using a specific chart. However, an adjustment value differs from one job to another even though the specific chart is used to adjust the position of the image formed on the sheet. The image position adjustment may or may not be appropriately performed depending on jobs.

The control over the stretch of the intermediate transfer belt as disclosed in Patent Literature 1 or the control over shakiness on a pair of resist rollers as disclosed in Patent Literature 2 is targeted at only a specific condition and cannot fully adjust the position of an image transferred to the sheet.

The present invention has been made in consideration of the foregoing. It is an object of the invention to suppress a change in the transportation direction magnification of images formed on sheets for each job.

In order to achieve the above-mentioned object, an image forming apparatus according to one aspect of the present invention includes a transporter, an image former, a transferrer, and a controller. The transporter transports a sheet. The image former forms an image. The transferrer is provided downstream of the image former along a transportation direction in which the transporter transports the sheet and transfers the image formed by the image former to the sheet. The controller selects an image adjustment chart used to adjust a transportation direction magnification for the image varying in the transportation direction and adjusts the transportation direction magnification for the image formed by the image former based on the image adjustment chart and a job condition of a job to be executed currently, the image adjustment chart being formed by the image former and transferred to the sheet by the transferrer.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention:

FIG. 7 is an explanatory diagram illustrating the other examples of the existing image adjustment chart according to the first embodiment of the present invention;

FIG. 8 is a graph illustrating the relationship between coverages and adjustment values for the transportation direction magnification according to the first embodiment of the present invention;

FIG. 9 is an explanatory diagram illustrating a configuration of two types of tables included in a correspondence table according to the first embodiment of the present invention;

DETAILED DESCRIPTION OF EMBODIMENTS

Figure 1:
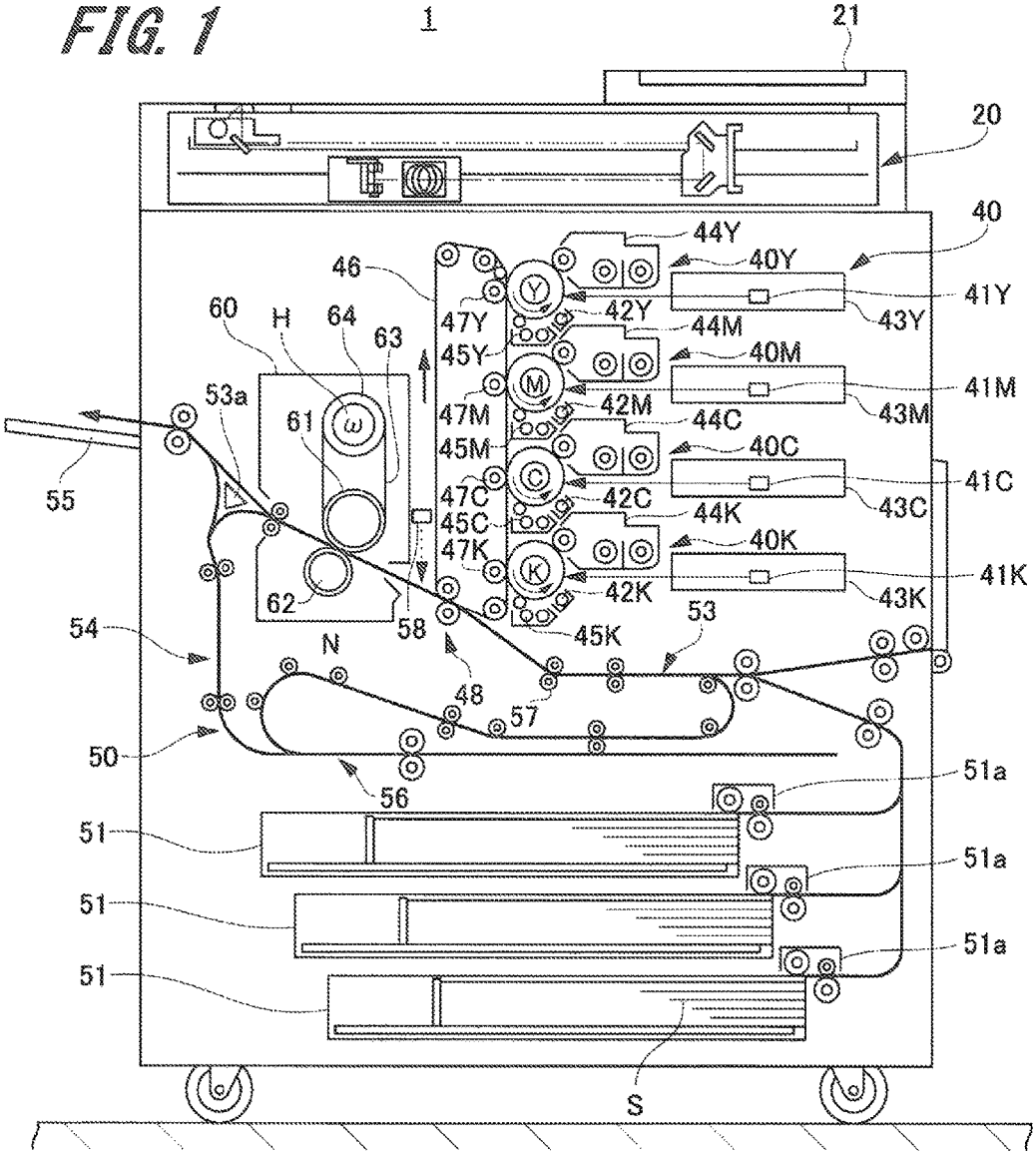
FIG. 1 is a schematic configuration diagram illustrating an example configuration of an image forming apparatus according to a first embodiment of the present invention.

Hereinafter, one or more embodiments of the present invention will be described with reference to the drawings. However, the scope of the invention is not limited to the disclosed embodiments. In the specification and the accompanying drawings, constituent elements having substantially the same functions or configurations are designated by the same reference numerals and a duplicate description is omitted.

First Embodiment

Example Hardware Configuration of the Image Forming Apparatus

FIG. 1 is a schematic configuration diagram illustrating an example configuration of an image forming apparatus 1 according to the first embodiment of the present invention. This block diagram illustrates only components or related components supposed to be necessary for the description of the present invention. The image forming apparatus is not limited to this example.

The image forming apparatus 1 exemplifies an image forming apparatus such as a copier in an electrophotographic system. The image forming apparatus 1 as illustrated in FIG. 1, also referred to as a tandem type color image forming apparatus, vertically places a plurality of photoreceptors so as to face one intermediate transfer belt, making it possible to form full-color images.

The image forming apparatus 1 includes an automatic document feeder 20 (ADF), an image former 40, a paper transporter 50, and a fuser 60.

The automatic document feeder 20 uses the optical system of a scanning exposure apparatus to apply scanning exposure to an image on a document and uses a line image sensor to read the reflected light and acquire an image signal.

The image former 40 forms an image transferred to sheet S by a secondary transferrer 48. The image former 40 includes an image former 40Y to form images in yellow (Y), an image former 40M to form images in magenta (M), an image former 40C to form images in cyan (C), and an image former 40K to form images in black (K).

The image former 40Y includes a photoreceptor drum Y, a nearby placed charger 42Y, an optical writer 43Y including a laser diode 41Y, a development apparatus 44Y, and a drum cleaner 45Y. Similarly, image formers 40M, 41C, and 41K respectively include photoreceptor drums M, C, and K, nearby placed chargers 42M, 42C, and 42K, optical writers 43M, 43C, and 43K including laser diodes 41M, 41C, and 41K, development apparatuses 44M, 44C, and 44K, and drum cleaners 45M, 45C, and 45K.

The charger 42Y evenly charges the surface of photoreceptor drum Y. Scanning exposure from the laser diode 41Y of the optical writer 43Y forms a latent image on photoreceptor drum Y. The development apparatus 44Y performs development using a toner to highlight the latent image on photoreceptor drum Y. An image corresponding to yellow is thereby formed on photoreceptor drum Y.

Similarly, the charger 42M evenly charges the surface of photoreceptor drum M. Scanning exposure from the laser diode 41M of the optical writer 43M forms a latent image on photoreceptor drum M. The development apparatus 44M performs development using a toner to highlight the latent image on photoreceptor drum M. An image corresponding to magenta is thereby formed on photoreceptor drum M.

The charger 42C evenly charges the surface of photoreceptor drum C. Scanning exposure from the laser diode 41C of the optical writer 43C forms a latent image on photoreceptor drum C. The development apparatus 44C performs development using a toner to highlight the latent image on photoreceptor drum C. An image corresponding to cyan is thereby formed on photoreceptor drum C.

The charger 42K evenly charges the surface of photoreceptor drum K. Scanning exposure from the laser diode 41K of the optical writer 43K forms a latent image on photoreceptor drum K. The development apparatus 44K performs development using a toner to highlight the latent image on photoreceptor drum K. An image corresponding to black is thereby formed on photoreceptor drum K.

Primary transfer rollers 47Y, 47M, 47C, and 47K successively transfer images formed on the photoreceptor drums Y, M, C, and K to predetermined positions on an intermediate transfer belt 46 as a belt-like intermediate transfer body.

The secondary transferrer 48 is provided downstream of the image former 40 in the transportation direction for the paper transporter 50 to transport sheet S and transfers an image formed by the image former 40 to sheet S. Images in respective colors are transferred to the intermediate transfer belt 46 and are transferred by the secondary transferrer 48 to sheet S that is transported by the paper transporter 50 at specified timing.

The paper transporter 50 includes a plurality of paper feeders 51, a paper feeder 51*a*, and various rollers. The paper feeders 51 store sheet S. The paper feeder 51*a* feeds sheet S stored in the paper feeder 51. The rollers are provided along a transportation path for sheet S. The paper transporter 50 includes a main transport path 53, a reversing transport path 54, and a catch tray 55. The main transport path 53 carries sheet S that is fed from the paper feeder 51. The reversing transport path 54 branches from the main transport path 53 downstream of the fuser 60 and flips sheet S. The catch tray 55 catches ejected sheet S.

The paper transporter 50 includes a reversing transport path 54 and a switching gate 53*a* provided at a branch to the main transport path 53. The paper transporter 50 transports sheet S in a specified transportation direction. The image forming apparatus 1 carries sheet S along the main transport path 53. A pair of resist rollers 57 corrects misalignment of sheet S. Sheet S then passes through the secondary transferrer 48 and the fuser 60. The image transferred to an upward face (surface) of sheet S is thereby fused to sheet S. When an image is to be formed on both sides of sheet S, sheet S whose upward face is formed with the image is transported from the main transport path 53 to the reversing transport path 54. A sheet reversing transport path 56 provided for the reversing transport path 54 flips sheet S to direct the image forming face (surface) of sheet S downward. Sheet S is then transported to the main transport path 53. Sheet S is thereby flipped to form the image on an image forming face (reverse) opposite to the upward face of sheet S.

The fuser 60 is provided downstream of the secondary transferrer 48 and fuses an image transferred by the secondary transferrer 48 onto sheet S. For this purpose, the fuser 60 transports sheet S by using a pair of an upper pressure roller 61 and a lower pressure roller 62 pressed to each other and performs a fusing process on sheet S containing a transferred image to fuse the image. The upper pressure roller 61 and the lower pressure roller 62 are used as fusing members. Heater H is provided inside the heating roller 64. Heater H heats the heating roller 64 and thereby heats a fusing belt 63 so that the heat is transferred to sheet S passing through fusing nip N including the fusing belt 63 and the lower pressure roller 62. The heated fusing belt 63 rotates and transfers the heat to the upper pressure roller 61 and transfers the heat to sheet S passing through fusing nip N. When sheet S is heated, the image on sheet S is melted and is fused onto sheet S. Therefore, the fusing belt 63 is also used as a fusing member to fuse images onto sheet S. As above, the secondary transferrer 48 transfers the image formed by the image former 40 to sheet S. The fuser 60 fuses the image to complete the printing.

The reader 58 is placed downstream of the secondary transferrer 48 and upstream of the fuser 60, namely, between the secondary transferrer 48 and the fuser 60. As indicated by a broken-line arrow in the drawing, the reader 58 reads an image that is transferred to the upward face of the sheet and is not yet fused by the fuser 60 while the sheet is transported along the main transport path 53 from the secondary transferrer 48 to the fuser 60. The reader 58 is capable of calculating the coverage of the image transferred to sheet S. The reader 58 outputs the calculated coverage to a controller 11 (see FIG. 3 to be described below).

Configuration of Major Components of the Image Forming Apparatus

Figure 2:
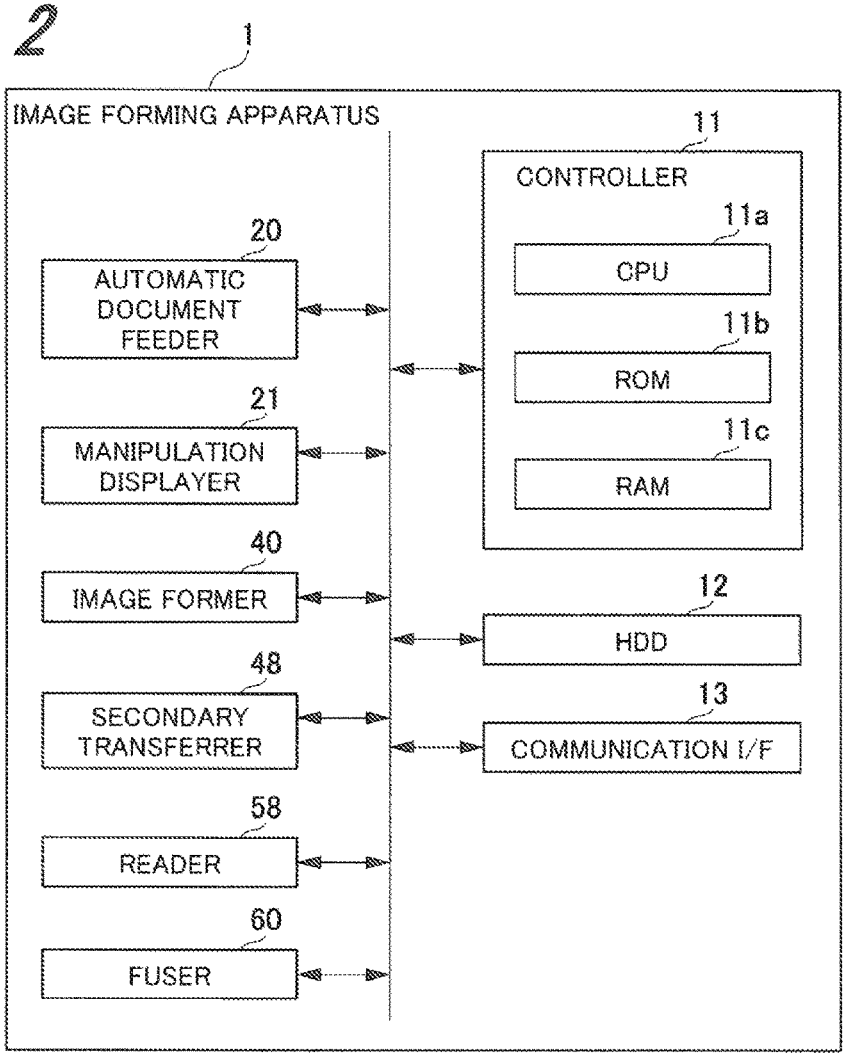
FIG. 2 is a hardware configuration diagram illustrating an example configuration of major components of the image forming apparatus according to the first embodiment of the present invention.

FIG. 2 is a hardware configuration diagram illustrating an example configuration of major components of the image forming apparatus 1.

The image forming apparatus 1 includes the controller 11, an HDD 12, and a communication I/F (interface) 13 in addition to the automatic document feeder 20, the manipulation displayer 21, the image former 40, the secondary transferrer 48, the reader 58, and the fuser 60 described above. The components in the image forming apparatus 1 are connected to each other via a bus.

The controller 11 includes a CPU 11*a*, a ROM 11*b*, and a RAM 11*c*. The controller 11 exemplifies a computer that controls operations of the components in the image forming apparatus 1. The controller 11 according to the present embodiment selects an image adjustment chart used to adjust the transportation direction magnification of an image that is transferred to sheet S and varies in the transportation direction.

The controller 11 adjusts the transportation direction magnification of an image formed by the image former 40 based on the image adjustment chart formed by the image former 40 and transferred to sheet S by the secondary transferrer 48 and a job condition of a job to be executed presently. The job condition is comparable to a type of parameter containing at least one of the coverage of an image transferred to sheet S by the secondary transferrer 48, the type of sheet S, and an environment to form the image on sheet S.

The CPU (Central Processing Unit) 11*a* controls an image forming process (print operation) of the image former 40 based on a print instruction from an operator by using the manipulation displayer 21 or the contents settled for the job, for example.

The ROM (Read Only Memory) 11*b* exemplifies a non-volatile memory and stores programs or data needed for the CPU 11*a* to operate.

The RAM (Random Access Memory) 11*c* exemplifies a volatile memory and temporarily stores information (data) needed for processes the CPU 11*a* performs.

The HDD 12 stores programs for the CPU 11*a* to control the components and programs and data for an OS (Operating System) or controllers. The ROM 11*b* also stores part of the programs and data stored in the HDD 12. The HDD 12 exemplifies a non-transitory computer-readable storage or recording medium storing a program executed by the CPU 11*a*. The non-transitory computer-readable storage or recording medium storing a program executed by the image forming apparatus 1 is not limited to the HDD but may be provided as SSD (Solid State Drive), CD-ROM, or DVD-ROM, for example.

The communication I/F 13 includes a NIC (Network Interface Card) or a modem, for example. The communication I/F 13 establishes a connection with apparatuses such as an unshown print controller and exemplifies a communicator that transmits and receives various types of data.

Figure 3:
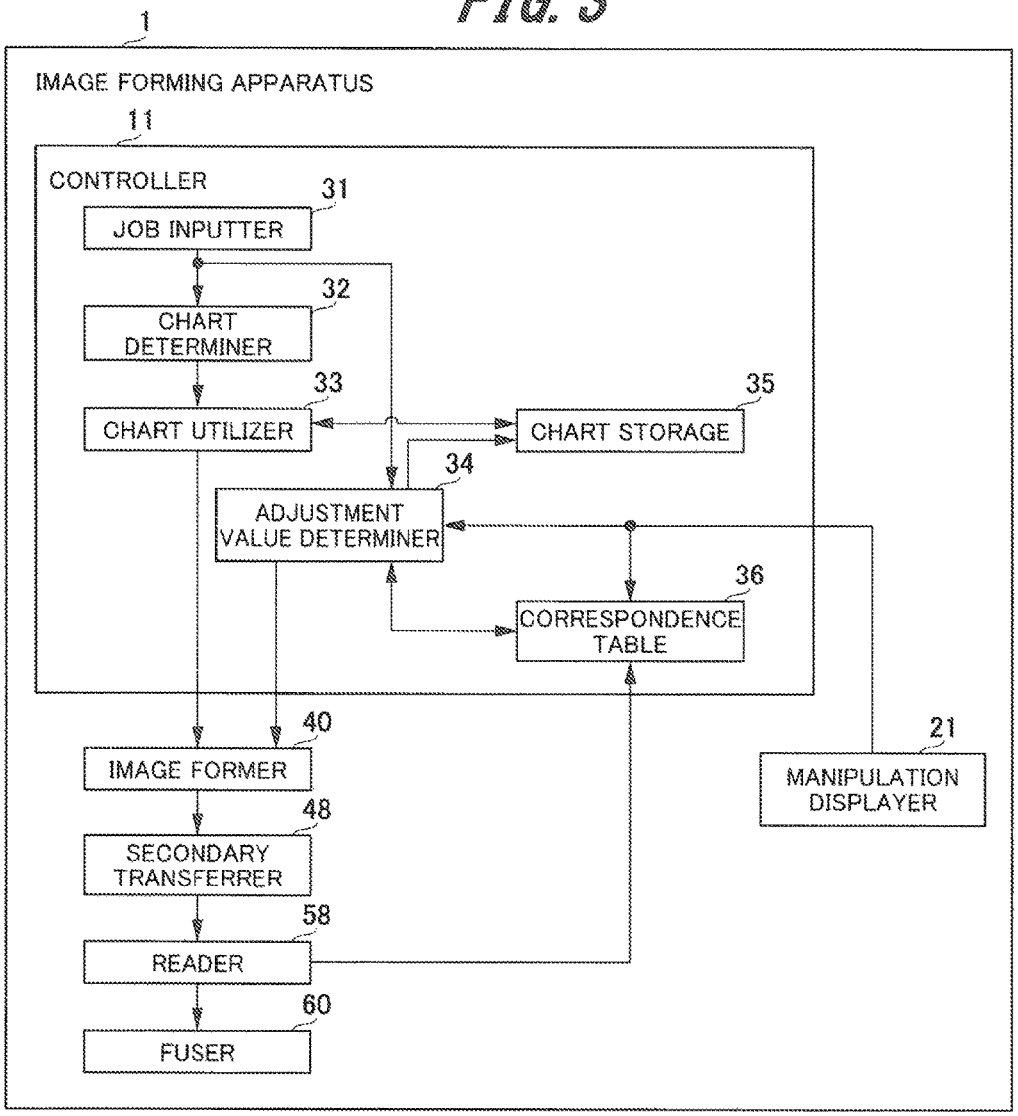
FIG. 3 is a block diagram illustrating an example internal configuration of a controller according to the first embodiment of the present invention.

FIG. 3 is a block diagram illustrating an example internal configuration of the controller 11.

The controller 11 includes a job inputter 31, a chart determiner 32, a chart utilizer 33, an adjustment value determiner 34, a chart storage 35, and a correspondence table 36. The job inputter 31, the chart determiner 32, the chart utilizer 33, and the adjustment value determiner 34 exemplify functions the CPU 11*a* illustrated in FIG. 2 implements by executing programs. The chart storage 35 and the correspondence table 36 provide data that are saved in the RAM 11*c* and are read by the CPU 11*a* as needed, for example. The correspondence table 36 may be stored in the HDD 12.

The controller 11 performs control to form an image adjustment chart on sheet S. The image adjustment chart is used to adjust the transportation direction magnification for an image. While visually examining the image adjustment chart formed on sheet S, an operator adjusts the transportation direction magnification for an image formed by the image former 40 based on a transportation direction magnification adjustment value input from the manipulation displayer 21. For example, it is supposed that a job image 100 mm long in the transportation direction is formed as is on the reverse of sheet S. Cooling sheet S changes the length of the image formed on sheet S in the transportation direction to 99 mm. In this case, the transportation direction magnification adjustment value is found to be 100/99. The manipulation displayer 21 inputs the adjustment value found to be 100/99. The controller 11 can thereby supply the image former 40 with a directive to form an image on sheet S based on the transportation direction magnification that can correct the image length in the transportation direction to 101 mm. After the image is formed on sheet S, sheet S ejected from the catch tray 55 is cooled to shrink, changing the length of the image formed on sheet S in the transportation direction to 100 mm.

For example, the transportation direction magnification of an image formed by the image former 40 on photoreceptor drum Y illustrated in FIG. 1 is adjusted in accordance with a transportation direction magnification adjustment value input from the manipulation displayer 21. Images are formed on photoreceptor drums M, C, and K similarly to photoreceptor drum Y based on the transportation direction magnification changed in accordance with the adjustment values. The secondary transferrer 48 then transfers the image based on the adjusted transportation direction magnification to sheet S. The image transferred to sheet S, therefore, maintains the adjusted transportation direction magnification.

The job inputter 31 is supplied with a job from an unshown client terminal or print controller connected to the image forming apparatus 1. The job inputter 31 is also supplied with a job that has been already executed and is read from the HDD 12. The job inputter 31 acquires a job image contained in the job based on job information about the input job. The job information contains the above-mentioned job condition and other information such as the number of sheets S to be printed.

The chart determiner 32 determines whether a job image formed on sheet S can be used as the image adjustment chart. For example, the chart determiner 32 determines a job image to be usable as the image adjustment chart when the image includes two or more color boundaries in the direction orthogonal to the transportation direction of sheet S and the color boundaries intersect with one straight line parallel to the transportation direction. A process performed by the chart determiner 32 to determine a job image will be described in detail with reference to FIG. 5.

The chart utilizer 33 allows the image former 40 to form the job image determined by the chart determiner 32 to be usable as the image adjustment chart. When the chart determiner 32 determines the job image to be unusable as the image adjustment chart, the chart utilizer 33 allows the image former 40 to form a job image supplemented with an existing image adjustment chart read from the chart storage 35.

At the first execution timing of the job, the adjustment value determiner 34 determines a transportation direction magnification adjustment value based on the coverage of an image transferred to sheet S. The coverage for sheet S is provided as a value calculated by the reader 58 to read an image that is transferred to sheet S by the secondary transferrer 48 and is not yet fused by the fuser 60. The operator manipulates the manipulation displayer 21 to supply the transportation direction magnification adjustment value based on the image adjustment chart formed on sheet S. The correspondence table 36 saves the adjustment value.

The adjustment value determiner 34 outputs the determined transportation direction magnification adjustment value to the image former 40. When a job is executed subsequently, the image former 40 forms an image with the adjusted transportation direction magnification in accordance with the adjustment value input from the adjustment value determiner 34. The adjustment value determiner 34 allows the correspondence table 36 to store the relationship between the coverage and the transportation direction magnification adjustment value and determines the transportation direction magnification adjustment value based on the coverage of a job image formed on sheet S in the course of job execution.

When the executed job is equal to the one already executed in the past, the adjustment value determiner 34 reuses the transportation direction magnification adjustment value stored in the correspondence table 36. The adjustment value determiner 34 determines whether the transportation direction magnification needs to be more highly accurately adjusted in consideration of an effect such as an environment or a paper lot included in the job condition. For example, a different paper lot causes a different outer shape accuracy as the size accuracy of sheet S. Therefore, the adjustment value determiner 34 needs to adjust the transportation direction magnification each time a job is input to the job inputter 31 even when the job to be executed is equal to an already executed job. It is possible to accurately adjust the transportation direction magnification for an image formed by the image former 40 even when jobs are not successively input to the job inputter 31 and a different paper lot of sheet S is used.

At the first execution timing of the job, the adjustment value determiner 34 allows the correspondence table 36 to save the adjustment value used to adjust the transportation direction magnification. When the job to be executed currently is equal to the already executed job and the environment (such as a room temperature) for the job to be executed currently is equal to the environment for the already executed job, the adjustment value determiner 34 can reuse the adjustment value read from the correspondence table 36.

The chart storage 35 stores an existing image adjustment chart. The existing image adjustment chart includes at least one of a register-mark chart and a grid-shaped chart. The register-mark chart includes a crisscrossed mark formed at each of four corners of sheet S. The grid-shaped chart includes two sets of parallel lines (totaled to four lines) intersecting at right angles formed along the edges of sheet S. The existing image adjustment chart stored in the chart storage 35 will be described in detail later with reference to FIG. 7.

The correspondence table 36 maintains the relationship between a coverage and an adjustment value of the transportation direction magnification. As illustrated in FIG. 9 to be described later, the correspondence table 36 includes a coverage adjustment value table **36*a* and a job adjustment value table 36*b*. The coverage adjustment value table 36*a* predetermines correspondence relationship between a coverage and an adjustment value of the transportation direction magnification. The job adjustment value table 36*b*** predetermines correspondence relationship among a job, a job condition, and an adjustment value of the transportation direction magnification.

The adjustment value determiner 34 references the coverage adjustment value table **36*a* and is thereby capable of acquiring a transportation direction magnification adjustment value corresponding to the coverage for each job. The relationship between the coverage for sheet S stored in the correspondence table 36 and the transportation direction magnification adjustment value will be described later in detail with reference to FIG. 8**.

The image former 40 forms an image based on the job image output from the controller 11. The secondary transferrer 48 transfers the image to sheet S. The reader 58 then reads the image transferred to sheet S. The fuser 60 fuses the image onto sheet S. In this case, the job adjustment value table 36*b* saves the coverage for sheet S calculated by the reader 58 as a job condition. The correspondence table 36 stores the coverage for sheet S and the transportation direction magnification adjustment value on a job or page basis. As above, the reader 58 calculates the coverage from the read image. The adjustment value is entered by an operator and is determined by the adjustment value determiner 34. When the job inputter 31 is supplied with the job equal to the already executed job, the adjustment value determiner 34 can reuse the transportation direction magnification adjustment value read from the job adjustment value table 36*b*.

Description of the Transportation Direction Magnification

As above, the fuser 60 heats and pressurizes sheet S whose surface contains a transferred image. Sheet S thereby swells. The image is transferred to the reverse of sheet S. Cooling sheet S heated and pressurized by the fuser 60 decreases the transportation direction magnification of the image printed on sheet S. The transportation direction magnification changes due to a job condition as well as heating and pressurization by the fuser 60. The job condition includes the coverage, the environment, and the paper type (such as size, basis weight, stiffness, and paper thickness), for example.

The coverage included in the job condition represents the usage rate (%) of toner used for sheet S per sheet, for example. For example, the entire sheet painted in solid black results in coverage 100% of black toner. A completely blank sheet without using black results in coverage 0% of black toner. The entire sheet painted in solid blue results in coverage 100% of cyan toner and coverage 100% of magenta toner and therefore represents coverage 200% in total. If the coverage increases, sheet S easily slips at a position where the secondary transferrer 48 transfers an image to sheet S. Consequently, the length of the image transferred to sheet S in the transportation direction is slightly shorter than the length of the image formed by the image former 40 in the transportation direction, decreasing the transportation direction magnification for the image formed on sheet S.

The environment included in the job condition provides indexes such as ambient temperature and humidity in a room where the image forming apparatus 1 is installed, for example. For example, increasing the ambient temperature decreases the transportation direction magnification for an image formed on sheet S. This is because increasing the ambient temperature swells sheet S. Even if an equally sized image is formed on the surface and the reverse of sheet S, cooling sheet S shrinks sheet S and reduces the image formed on the reverse.

The paper type included in the job condition provides indexes to specify the type of sheet S such as basis weight, stiffness, and paper thickness of sheet S. The basis weight provides an index representing the weight of sheet S per square meter. The stiffness represents resistivity of sheet S when bent. Generally, the stiffness increases as the basis weight and the paper thickness increase. The paper thickness represents the thickness of sheet S per sheet. For example, increasing the paper thickness decreases the transportation direction magnification for an image formed on sheet S.

Examples of Transportation Direction Magnifications Varying with Paper Types

Figure 4:
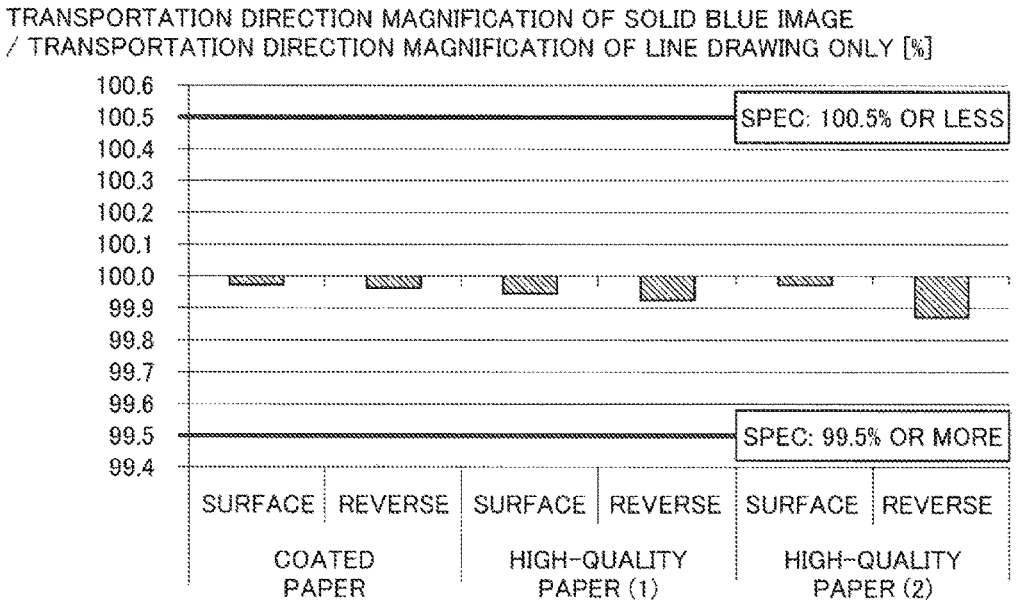
FIG. 4 is a graph illustrating a transportation direction magnification ratio of the transportation direction magnification of a sheet fused with a solid blue image to the transportation direction magnification of a sheet fused with an image comprised of line drawing only according to the first embodiment of the present invention.

With reference to FIG. 4, the description below explains examples of transportation direction magnifications varying with different paper types.

FIG. 4 is a graph illustrating a transportation direction magnification ratio of the transportation direction magnification of sheet S fused with a solid blue image to the transportation direction magnification of sheet S fused with an image comprised of line drawing only.

The graph provides transportation direction magnification ratios on the surface and the reverse of each of coated paper and high-quality paper (1) and (2) as types of sheet S. High-quality paper (1) is heavier than high-quality paper (2) per sheet. For example, the high-quality paper (1) weighs 105 g/m$^2$. The high-quality paper (2) weighs 52.3 g/m$^2$. The transportation direction magnification ratio is 100.0% if the transportation direction magnification of sheet S fused with an image comprised of line drawing only is equal to the transportation direction magnification ratio of sheet S fused with a solid blue image. The transportation direction magnification ratio decreases to 99.9% or 99.8% if the transportation direction magnification of sheet S fused with an image comprised of line drawing only is larger than the transportation direction magnification of sheet S fused with a solid blue image. The transportation direction magnification ratio increases to 100.1% or 100.2% if the transportation direction magnification of sheet S fused with a solid blue image is larger than the transportation direction magnification of sheet S fused with an image comprised of line drawing only. The transportation direction magnification ratio is allowed to vary within a range between 99.5% and 100.5%.

On the surface of the coated paper, for example, the transportation direction magnification of sheet S fused with an image comprised of line drawing only and the transportation direction magnification ratio of sheet S fused with a solid blue image are found. Then, a transportation direction magnification ratio based on the transportation direction magnifications on the surface of the coated paper is found. Both faces of the coated paper are coated with a coating material to improve the smoothness. The coated paper, if swelled, causes a small change even when the fuser 60 heats and pressurizes the coated paper. Therefore, only a slight transportation direction magnification ratio is found on the surface of the coated paper. The transportation direction magnification ratio on the reverse of the coated paper is similar to the transportation direction magnification ratio on the surface of the coated paper.

Now the transportation direction magnification ratios for the types of sheet S are compared. For example, the transportation direction magnification ratios on the surface and the reverse of the high-quality paper (1) are greater than the transportation direction magnification ratios on the surface and the reverse of the coated paper. The transportation direction magnification ratio on the surface of the high-quality paper (2) is approximately equal to the transportation direction magnification ratio on the surface of the coated paper. However, the transportation direction magnification ratio on the reverse of the high-quality paper (2) is much greater than the transportation direction magnification ratio on the reverse of each of the coated paper and the high-quality paper (1). Namely, decreasing the weight of sheet S increases the transportation direction magnification ratio.

The transportation direction magnification ratios on the surface and the reverse depend on the types of sheet S. The transportation direction magnification ratio on the reverse tends to be greater than the transportation direction magnification ratio on the surface. Therefore, when an image is transferred to the reverse of sheet S and is fused at the same magnification as that of an image transferred to the surface of sheet S, after sheet S is cooled, there occurs a difference in the sizes of the images on the surface and the reverse of sheet S. To solve this, the image forming apparatus 1 provides the image adjustment chart capable of adjusting positions of images formed on the surface and the reverse of sheet S based on job conditions.

Figure 5:
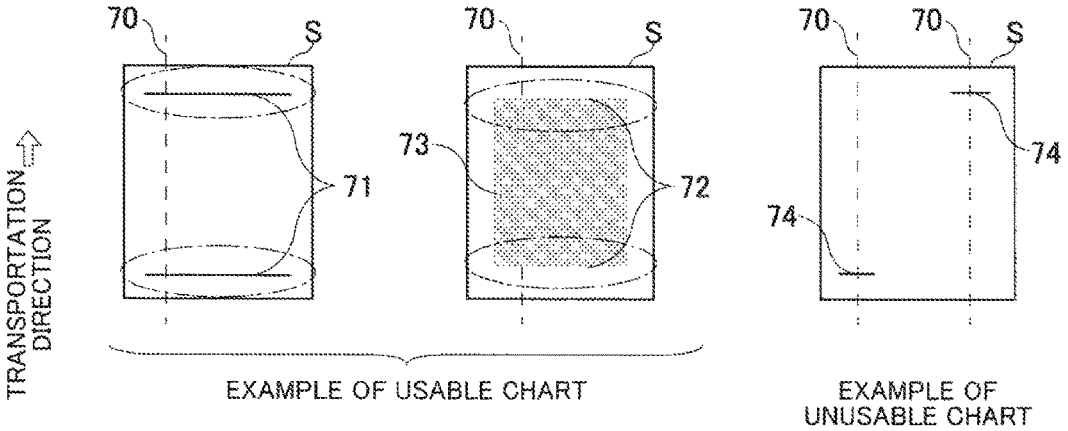
FIG. 5 is an explanatory diagram illustrating charts usable or unusable for adjustment of the transportation direction magnification according to the first embodiment of the present invention.

Examples of Image Adjustment Charts Usable or Unusable for Adjustment of the Transportation Direction Magnification FIG. 5 is an explanatory diagram illustrating image adjustment charts usable or unusable for adjustment of the transportation direction magnification. The image adjustment charts illustrated in FIG. 5 are images formed on sheet S. The catch tray 55 ejects sheet S containing the image adjustment chart formed as an image. An operator adjusts the transportation direction magnification by referring to the image adjustment chart formed on sheet S ejected from the image forming apparatus 1.

There are provided two types of images as the image adjustment charts used to adjust the transportation direction magnification as described below.

A first chart image illustrated at the left of FIG. 5 includes at least two straight lines 71 provided in the direction orthogonal to the transportation direction of sheet S. FIG. 5 highlights regions including the two straight lines 71 surrounded by ellipses with dot-and-dash lines. The two straight lines 71 each ensure a specified length (such as 1 cm) or more in the direction orthogonal to the transportation direction of sheet S and are placed on a virtual straight line 70 provided in parallel with the transportation direction. The two straight lines 71 are placed on the virtual straight line 70 so that the operator can measure the length between the two straight lines 71 using a ruler on sheet S. The operator cannot accurately measure the length between the two straight lines 71 using a ruler unless the two straight lines 71 are placed on the virtual straight line 70. The virtual straight line 70 is provided for the purpose of description and is not formed on sheet S. However, the virtual straight line 70 may be formed on sheet S used as an indication enabling the operator to determine whether a job image formed on sheet S is usable as the chart image.

A second chart image illustrated at the center of FIG. 5 includes boundaries 72 provided in the direction orthogonal to the transportation direction of sheet S. The boundary 72 represents a difference between the color of job image 73 capable of being visually recognized by the operator and the color of sheet S. Namely, the boundary 72 is represented as a difference between the job image 73 and the color (such as white) of sheet S itself. The second chart image requires at least two boundaries 72. In this example, the job image 73 is formed inside sheet S. As illustrated in FIG. 5, an ellipse with a dot-and-dash line encloses and highlights an area including the boundary 72 between the base of sheet S and the job image 73. The two boundaries 72 each ensure a specified length (such as 1 cm) or more in the direction orthogonal to the transportation direction of sheet S and are placed on the virtual straight line 70 provided in parallel with the transportation direction. FIG. 5 shows the solid-color image as an example of the job image 73. However, the job image 73 may be provided as a multicolor poster image, for example.

The chart utilizer 33 reuses job images input to the image forming apparatus 1 to provide the first and second chart images. Job images reusable for the first and second chart images include a line drawing and a solid-color image, for example. As the job is executed, the image forming apparatus 1 ejects sheet S where the image former 40 forms the first or second chart image. The operator can then confirm the first or second chart image formed on sheet S and can adjust the transportation direction magnification.

Example of an Image Adjustment Chart Unusable for Adjustment of the Transportation Direction Magnification The right side of FIG. 5 illustrates a chart unusable for adjustment of the transportation direction magnification. The unusable chart includes at least two straight lines 74 provided in the direction orthogonal to the transportation direction of sheet S. However, the straight line 74 is short. The two straight lines 74 are not placed on the virtual straight line 70 provided in parallel with the transportation direction.

Similarly, the chart determiner 32 assumes two color boundaries, if any, to be unusable charts when the two color boundaries are provided in the direction orthogonal to the transportation direction of sheet S but are not placed on the virtual straight line 70 provided in parallel with the transportation direction.

A letter as a job image may be input to the image forming apparatus 1 but cannot be used as the image adjustment chart. When the job image is treated as an unusable chart, the image former 40 forms the job image covered with an existing image adjustment chart image acquired from the chart storage 35. The operator can thereby confirm the existing image adjustment chart image formed on sheet S and can adjust the transportation direction magnification.

Examples of an Existing Image Adjustment Chart

Figure 6:
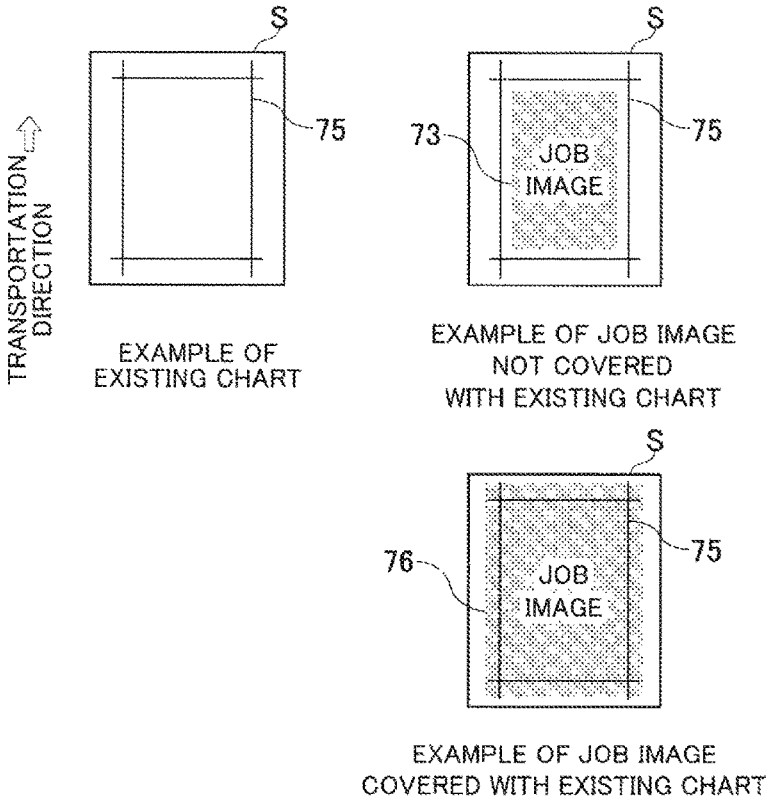
FIG. 6 is an explanatory diagram illustrating the relationship between an existing image adjustment chart and a job image according to the first embodiment of the present invention.

FIG. 6 is an explanatory diagram illustrating the relationship between an existing image adjustment chart and a job image.

The top left side of FIG. 6 illustrates an existing image adjustment chart stored in the chart storage 35. In FIG. 6, the existing image adjustment chart is represented as a grid-shaped chart 75 made of four straight lines combined with each other, for example.

The top right side of FIG. 6 illustrates the job image 73 not covered with the grid-shaped chart 75. In this example, the job image 73 is smaller than the grid-shaped chart 75. Therefore, the grid-shaped chart 75 is formed outside the job image 73. When the grid-shaped chart 75 is formed in this manner, the operator adjusts the transportation direction magnification by using sheet S formed with the job image 73 and then cuts out the area where the grid-shaped chart 75 is formed. Sheet S can be thus used as deliverables.

The bottom right of FIG. 6 illustrates a job image 76 covered with the grid-shaped chart 75. In this example, the job image 76 is larger than the grid-shaped chart 75. Therefore, the grid-shaped chart 75 is formed inside the job image 76. Sheet S formed with the job image 76 cannot be used as deliverables if the job image 76 is covered with the grid-shaped chart 75. The job image 76 needs to be newly formed and output on sheet S.

Image adjustment charts stored in the chart storage 35 are not limited to the grid-shaped chart 75. For example, a straight line to specify the position to cut sheet S may be used as an existing image adjustment chart.

FIG. 7 is an explanatory diagram illustrating the other examples of the existing image adjustment chart.

The left side of FIG. 7 shows the grid-shaped chart 75 as the first example of the existing image adjustment chart comprised of four straight lines illustrated in FIG. 6.

The center of FIG. 7 shows the second example of the existing image adjustment chart including four crisscrossed register-mark charts 77 each formed at the four corners of sheet S. The register-mark chart 77 may be used to form an image not covering the job image 73 or an image covering the job image 76 as illustrated in FIG. 6. The register-mark chart 77 may be used to adjust the transportation direction magnification.

The right side of FIG. 7 shows the third example of the existing image adjustment chart including a solid-color image 78 at coverage 20%. In many cases, the image forming apparatus 1 successively forms similar job images on sheet S. The coverage of a job formed by the image forming apparatus 1 ensures a constant value and can be simply settled. When the job coverage ensures a constant value, the solid-color image 78 assigned the predetermined coverage is used as an existing image adjustment chart. Therefore, the operator can measure the solid-color image 78 formed on sheet S in the transportation direction, find a variation in the transportation direction magnification, and adjust the transportation direction magnification.

The chart utilizer 33 can select and use diversely shaped existing image adjustment charts depending on job image shapes. For example, when a job image smaller than sheet S is formed approximately at the center of sheet S, the chart utilizer 33 uses the register-mark chart 77 illustrated at the center of FIG. 7 as an existing image adjustment chart. When a job image is formed only at the right side of sheet S, the chart utilizer 33 may use two register-mark charts 77 as existing image adjustment charts at the left side of sheet S where no job image is formed.

Relationship Between Coverages and Adjustment Values for the Transportation Direction Magnification FIG. 8 is a graph illustrating the relationship between coverages and adjustment values for the transportation direction magnification. In this graph, the horizontal axis represents the coverage for each job. The vertical axis represents a transportation direction magnification adjustment value that is input in accordance with the coverage.

The coverage for each job in FIG. 8 signifies an average coverage representing an average value of coverages calculated by the adjustment value determiner 34 correspondingly to jobs. The adjustment value determiner 34 calculates the average coverage as a value in terms of all job images included in the job based on a coverage calculated by the reader 58. For example, when one job includes a job image with coverage 80% on the first page and another job image with coverage 10% on the second page, the average coverage is calculated as (80+10)/2=45%.

As seen from a plot in FIG. 8, increasing the coverage for each job also increases the transportation direction magnification adjustment value. Therefore, there is a certain degree of correlation between the coverage for sheet S and the transportation direction magnification adjustment value. The relationship between the coverage and the transportation direction magnification adjustment value can be represented by a straight line 81 as a primary expression linearly approximated by the method of least squares in the graph, for example. The relationship between the average coverage and the transportation direction magnification adjustment value may be approximated by a curve as a quadratic expression, for example.

The adjustment value determiner 34 can determine a transportation direction magnification adjustment value corresponding to the job based on the straight line 81 as a primary expression that linearly approximates the relationship between the average coverage and the transportation direction magnification adjustment value. Namely, the adjustment value determiner 34 determines the transportation direction magnification adjustment value corresponding to the coverage for sheet S calculated by the reader 58 by using the coverage adjustment value table 36*a* in FIG. 9 to be described later. The image former 40 is supplied with the transportation direction magnification adjustment value. The adjustment value determiner 34 can thereby adjust the transportation direction magnification of an image formed by the image former 40 based on the coverage average value.

An average coverage may be calculated based on a tail-threading achievement such as the number of pages for sheet S that is printed on the image forming apparatus 1. In this case, the adjustment value determiner 34 may calculate a weekly time average, an average coverage by an average of every 10,000 sheets, or an average coverage by an average of every job.

When the average coverage is calculated, a solid-color image corresponding to the average coverage illustrated at the left side of FIG. 7 can be used as an existing image adjustment chart. When the solid-color image is represented by an average of coverages calculated based on the tail threading achievement representing the actual number of ejected sheets S formed with job images, the adjustment value determiner 34 adds the solid-color image as an existing image adjustment chart to the chart storage 35. The adjustment value determiner 34 can thereby determine a transportation direction magnification adjustment value corresponding to the average coverage for sheet S read from the coverage adjustment value table 36*a* and output the transportation direction magnification adjustment value to the image former 40.

Example Configuration of the Correspondence Table

FIG. 9 is an explanatory diagram illustrating a configuration of two types of tables included in the correspondence table 36. The correspondence table 36 includes a coverage adjustment value table 36*a* and a job adjustment value table 36*b*.

The coverage adjustment value table 36*a* includes a coverage field and a transportation direction magnification adjustment value field.

The coverage field stores average coverage values illustrated in FIG. 8.

The transportation direction magnification adjustment value field stores adjustment values for the transportation direction magnification corresponding to the average coverage illustrated in FIG. 8.

The coverage adjustment value table 36*a* saves data representing the correlation between the average coverage and the transportation direction magnification adjustment value described in FIG. 8. The adjustment value determiner 34 generates the coverage adjustment value table 36*a* based on the graph illustrated in FIG. 8. The graph in FIG. 8 and the coverage adjustment value table 36*a* include almost the same contents. The adjustment value determiner 34 can thereby determine a transportation direction magnification adjustment value corresponding to the average coverage for sheet S read from the coverage adjustment value table 36*a* and output the transportation direction magnification adjustment value to the image former 40.

The job adjustment value table 36*b* includes a job ID field, a job condition field, and a transportation direction magnification adjustment value field.

The job ID field stores a job ID that uniquely specifies a job. The job ID field may store a job name, for example, instead of a job ID if the job name can uniquely specify the job.

The job condition field stores a job condition for a job that is specified by the job ID and is already executed. For example, the job condition field stores the environment including the ambient temperature at which the job was executed. The job condition field may store a paper type of sheet S.

The transportation direction magnification adjustment value field stores a transportation direction magnification adjustment value determined by the adjustment value determiner 34 when the job specified by the job ID was executed.

The job adjustment value table 36*b* stores the job ID of an already executed job, the job condition, and the transportation direction magnification adjustment value specified in the past. When the job ID of the currently executed job is equal to the job ID of the already executed job, the adjustment value determiner 34 can acquire the transportation direction magnification adjustment value determined for the already executed job from the job adjustment value table 36*b*. The adjustment value same as that for the already executed job can be used to adjust the transportation direction magnification for the image former 40.

When the ambient temperature used to execute the current job differs from the ambient temperature used to have executed the job in the past, the transportation direction magnification is also highly likely to change. Therefore, it is necessary to recalculate a transportation direction magnification adjustment value if the job condition for the job to be executed currently differs from the job condition that was used to execute the job in the past and is stored in the job adjustment value table 36*b*.

Processes of the Image Forming Apparatus

Figure 10:
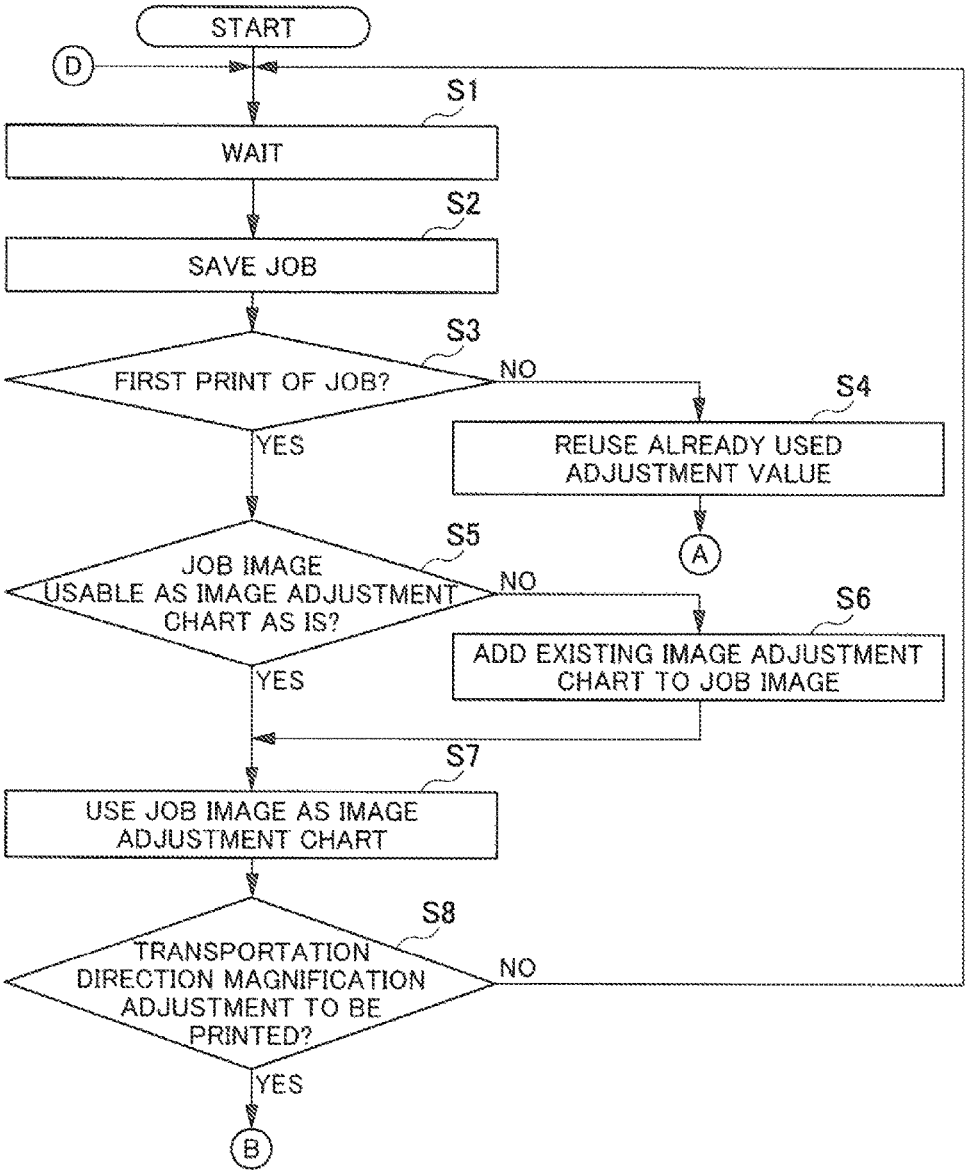
FIG. 10 is a flowchart illustrating a process to select an image adjustment chart performed in the image forming apparatus according to the first embodiment of the present invention.
Figure 11:
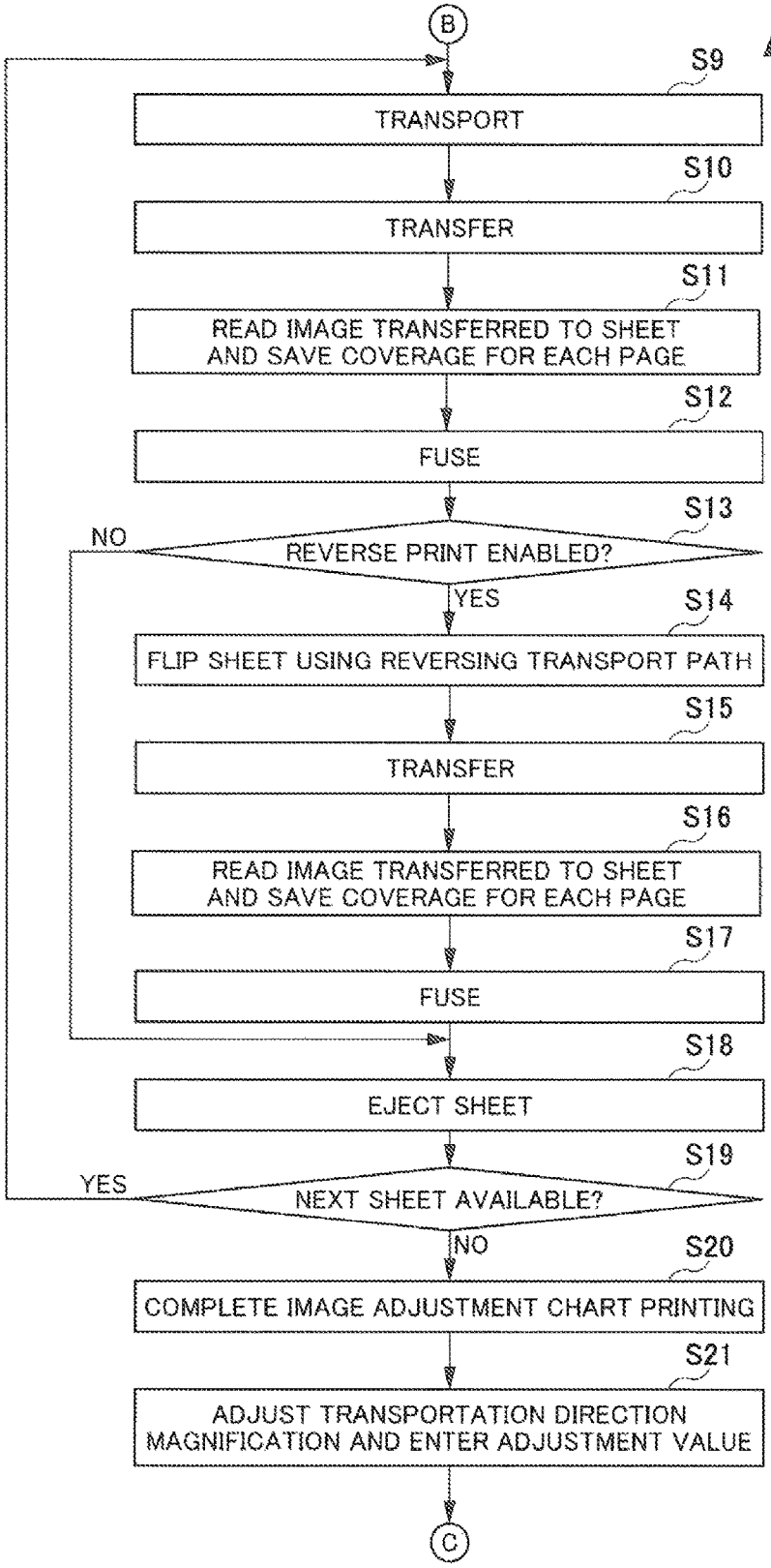
FIG. 11 is a flowchart illustrating a process to print an image adjustment chart and adjust the transportation direction magnification performed in the image forming apparatus according to the first embodiment of the present invention.
Figure 12:
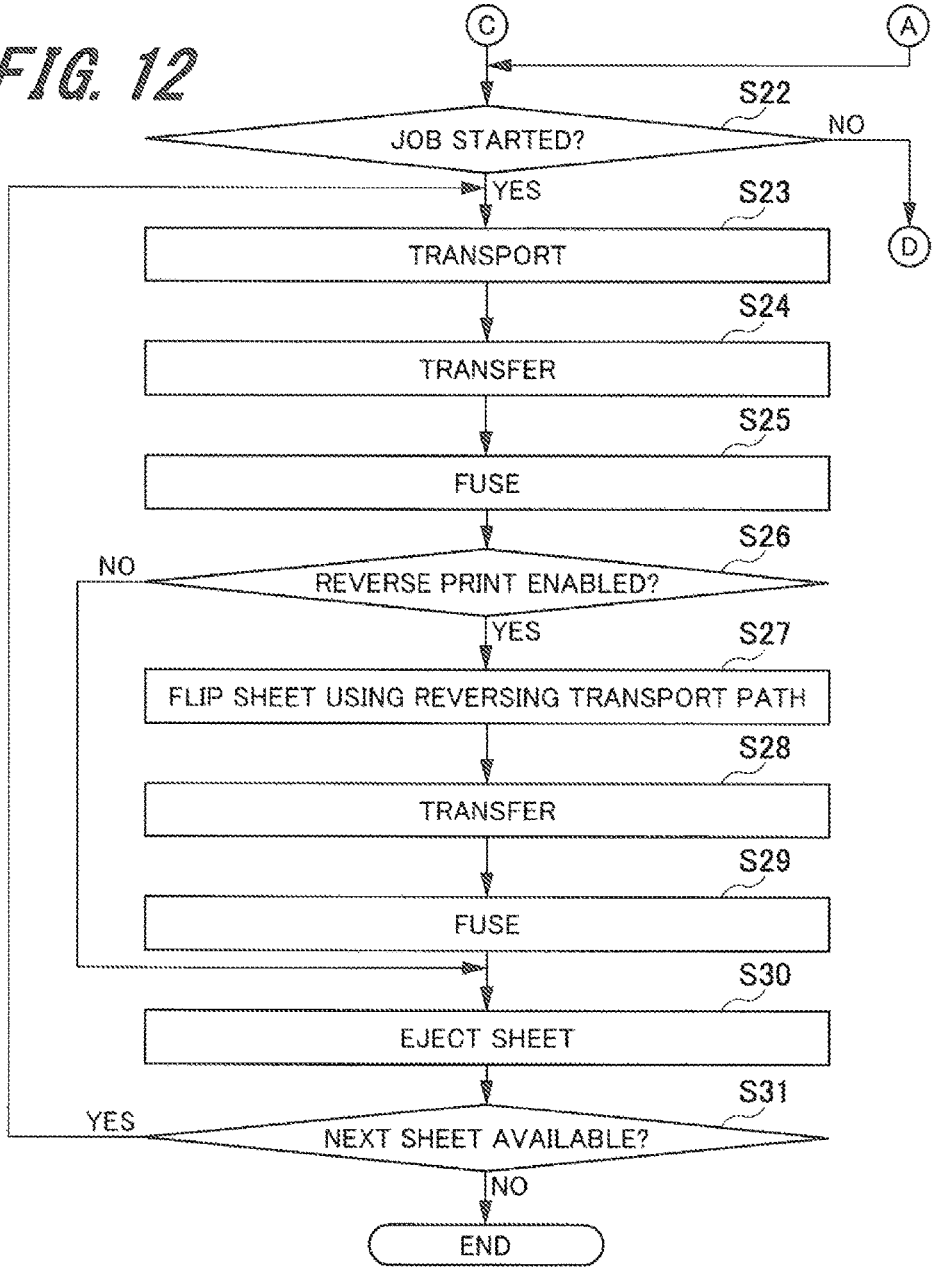
FIG. 12 is a flowchart illustrating a process to perform a job based on the adjusted transportation direction magnification performed in the image forming apparatus according to the first embodiment of the present invention.

With reference to FIGS. 10 through 12, the description below explains processes performed by the image forming apparatus 1.

FIGS. 10 through 12 are flowcharts illustrating processes performed by the image forming apparatus 1. FIG. 10 illustrates a process to select an image adjustment chart. FIG. 11 illustrates a process to print an image adjustment chart and adjust the transportation direction magnification. FIG. 12 illustrates a process to execute a job based on the adjusted transportation direction magnification.

The job inputter 31 of the image forming apparatus 1 waits until an unshown client terminal or print controller inputs a job (S1). When a job is input, the job inputter 31 saves the job in the HDD 12 (S2), for example. When the job is executed, the subsequent process is performed based on the job saved in the HDD 12. In step S1, if the job inputter 31 is supplied with a job that is saved in the HDD 12 and was executed in the past, the process in step S2 to save the job in the HDD 12 is not performed and proceeds to next step S3.

The job inputter 31 determines whether the job saved in the HDD 12 is printed for the first time (S3). If the job is not printed for the first time (NO in S3), the job saved in the HDD 12 was actually used for printing. The adjustment value determiner 34 reads the transportation direction magnification adjustment value used for the already executed job from the job adjustment value table 36*b* of the correspondence table 36, reuses the adjustment value (S4), and proceeds to a process to determine the start of a job in FIG. 12 connected to connector A (S22). If the job condition used to execute the job in the past differs from the job condition used to execute the current job, the process in step S4 is not performed. The process in step 5 and later is performed.

In step S3, if the job inputter 31 determines that the job is printed for the first time (YES in S3), the chart determiner 32 determines whether the job image for the job saved in the HDD 12 can be directly used as an image adjustment chart (S5). If the chart determiner 32 determines that the job image can be used as an image adjustment chart (YES in S5), the chart utilizer 33 uses the job image as an image adjustment chart (S7).

If the chart determiner 32 determines that the job image cannot be used as an image adjustment chart (NO in S5), the chart utilizer 33 supplements the job image with an existing image adjustment chart read from the chart storage 35 (S6). The chart utilizer 33 uses the job image supplemented with the existing image adjustment chart as an image adjustment chart (S7).

The chart utilizer 33 determines whether to print the transportation direction magnification adjustment, namely, the image adjustment chart (S8). If the transportation direction magnification adjustment is not printed (NO in S8), control returns to step S1 and the job inputter 31 continues to await a job to be input. If the transportation direction magnification adjustment is printed (YES in S8), the paper transporter 50 starts transporting sheet S (S9 in FIG. 11) as indicated by connector B.

The secondary transferrer 48 transfers the image formed by the image former 40 to sheet S (S10). The reader 58 reads the image transferred to sheet S on a page basis. The reader 58 calculates the coverage for each page. The coverage is saved in the coverage adjustment value table 36*a* of the correspondence table 36 (S11). The fuser 60 fuses the image transferred to sheet S onto sheet S (S12).

The controller 11 determines whether reverse print is enabled for sheet S based on the job information (S13). If the reverse print is not enabled for sheet S (NO in S13), the controller 11 ejects sheet S containing the image fused only onto the surface to the catch tray 55 (S18). In this case, an operator uses a scale, for example, to measure the length from the end of sheet S in the transportation direction to the image printed on either side of sheet S, recognizes a change in the transportation direction magnification, and enters a transportation direction magnification adjustment value to the manipulation displayer 21.

If the reverse print is enabled for sheet S (YES in S13), based on the image printed on both sides of sheet S, the operator recognizes a change in the transportation direction magnification and enters a transportation direction magnification adjustment value. The controller 11, therefore, allows the reversing transport path 54 to flip sheet S (S14).

The secondary transferrer 48 transfers the image formed by the image former 40 to the reverse of sheet S (S15). The reader 58 reads the image transferred to sheet S. The reader 58 saves the coverage calculated for each page in the coverage adjustment value table 36*a* of the correspondence table 36 (S16). The fuser 60 fuses the image transferred to sheet S onto sheet S (S17). The controller 11 ejects sheet S containing the image fused on the surface and the reverse to the catch tray 55 (S18).

The controller 11 determines whether there is a next sheet to print the image adjustment chart (S19). If the next sheet is available (YES in S19), the controller 11 returns to step S9, stars transporting the next sheet, and performs the subsequent process. If the next sheet is unavailable (NO in S19), steps S1 through S19 to print the image adjustment chart are complete (S20). The operator removes sheet S with the image printed on the surface only or sheet S with the image printed on the surface and the reverse from the catch tray 55.

The operator confirms the image adjustment chart printed on the removed sheet S and enters an adjustment value to adjust the transportation direction magnification for the image from the manipulation displayer 21 (S21). The adjustment value entered from the manipulation displayer 21 is stored in the job adjustment value table 36*b* of the correspondence table 36. The adjustment value determiner 34 outputs the settled adjustment value from the job adjustment value table 36*b* to the image former 40. The subsequent job is executed while the image position of the image formed by the image former 40 is adjusted. When the current job is executed, the adjustment value entered by the operator is associated with the job ID and is saved in the job adjustment value table 36*b* of the correspondence table 36.

In step S4, if it is possible to reuse the transportation direction magnification adjustment value settled for an already executed job, the adjustment value determiner 34 reads the transportation direction magnification adjustment value from the job adjustment value table 36*b* based on the job ID of the job to be executed currently. The transportation direction magnification adjustment value is then output to the image former 40.

In step S22 of FIG. 12 connected by connector C from step S21 in FIG. 11, the controller 11 determines whether the job execution starts (S22). If the job execution does not start (NO in S22), the controller 11 returns to step S1 of FIG. 10 connected by connector D and waits (S1).

If the job execution starts (YES in S22), the controller 11 transports sheet S (S23), transfers the image to sheet S (S24), fuses the image transferred to sheet S (S25), and determines whether the reverse print is enabled (S26). These processes are similar to those in steps S9, S10, S12, and S13 of FIG. 11.

If the reverse print is not enabled for sheet S (NO in S26), the controller 11 ejects sheet S containing the image fused only onto the surface to the catch tray 55 (S30). If the reverse print is enabled for sheet S (YES in S26), the controller 11 allows the reversing transport path 54 to flip sheet S (S27). Subsequently, the controller 11 provides control to transfer the image to the reverse of sheet S (S28), fuse the image transferred to sheet S (S29), and eject sheet S containing the image fused on the surface and the reverse (S30). These processes are similar to those in steps S15, S17, and S18 of FIG. 11.

The controller 11 determines whether there is the next sheet needed for the job execution (S31). If the next sheet is available (YES in S31), the controller 11 returns to step S23, starts transporting the next sheet, and performs the subsequent process. If the next sheet is unavailable (NO in S31), the job execution is complete and the process terminates.

The above-mentioned image forming apparatus 1 according to the first embodiment adjusts the transportation direction magnification for images by using the image adjustment chart selected in accordance with the job condition. It is possible to appropriately adjust the transportation direction magnification for images varying with job conditions.

The chart determiner 32 can automatically determine whether the job image can be used as an image adjustment chart. When the job image can be used as an image adjustment chart, the chart utilizer 33 can use the job image as an image adjustment chart when the job image is transferred to sheet S and is not fused by the fuser 60 yet. An operator can visually examine deliverables printed with the job image and correct the transportation direction magnification adjustment value. After the transportation direction magnification for the image is adjusted, sheet S formed with the job image can be used as deliverables. If the job image cannot be used as an image adjustment chart, the existing image adjustment chart can be used to adjust the transportation direction magnification for the image as usual.

The transportation direction magnification adjustment value may be manually input by an operator using the manipulation displayer 21 or may be automatically input by the adjustment value determiner 34 using an adjustment value acquired from the correspondence table 36. When the adjustment value is automatically input, the adjustment value determiner 34 reuses the transportation direction magnification adjustment value settled based on the already executed job for the job to be executed currently. It is possible to relieve the operator of necessity to input a transportation direction magnification adjustment value each time the job is executed.

The transportation direction magnification can be adjusted by using not only an image printed on both sides of sheet S but also an image printed on only either side of sheet S. In this case, the operator recognizes a change in the transportation direction magnification based on the length from the end of sheet S in the transportation direction to the image printed on either side of sheet S and enters a transportation direction magnification adjustment value. Thereby, it is possible to adjust the transportation direction magnification.

Second Embodiment

The description below explains the image forming system according to the second embodiment of the present invention.

Figure 13:
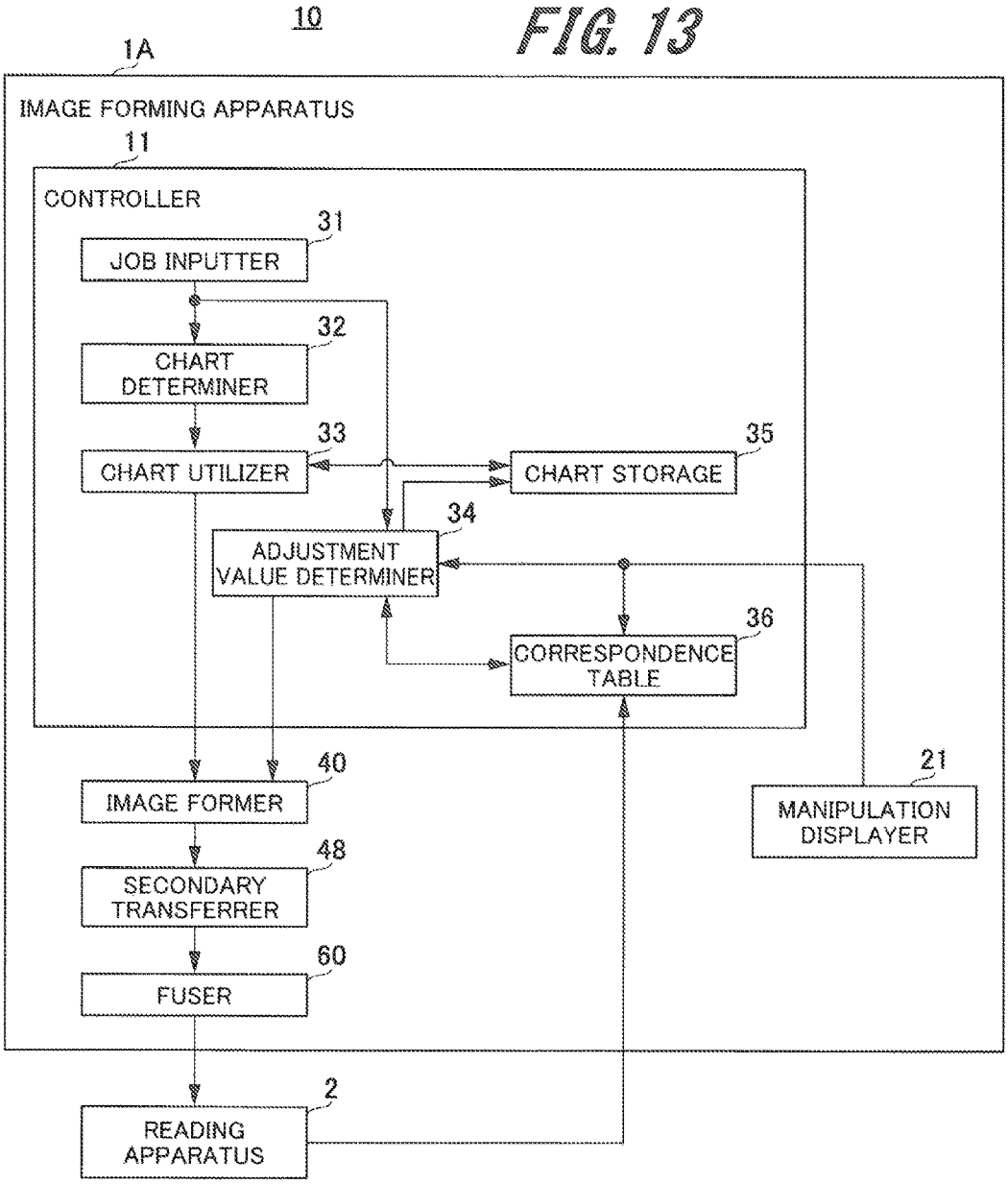
FIG. 13 is a block diagram illustrating a schematic configuration of an image forming system according to a second embodiment of the present invention.

FIG. 13 is a block diagram illustrating a schematic configuration of an image forming system 10.

The image forming system 10 includes an image forming apparatus 1A and a reading apparatus 2 (an example of the reader) connected posterior to the image forming apparatus 1A.

The image forming apparatus 1A is configured almost similarly to the above-mentioned image forming apparatus 1 according to the first embodiment but differs from the same in that the reader 58 and the catch tray 55 are not included. Therefore, the image forming apparatus 1A outputs sheet S containing an image fused by the fuser 60 to the reading apparatus 2.

The reading apparatus 2 reads an image fused onto sheet S by the fuser 60 of the image forming apparatus 1A from upward and downward of sheet S simultaneously and is thereby capable of calculating the coverage of the image printed on the surface and the reverse of sheet S on a side basis. The reading apparatus 2 transmits the calculated coverage for sheet S to the image forming apparatus 1A. The image forming apparatus 1A saves the coverage for sheet S in the coverage adjustment value table 36*a* of the correspondence table 36.

Figure 14:
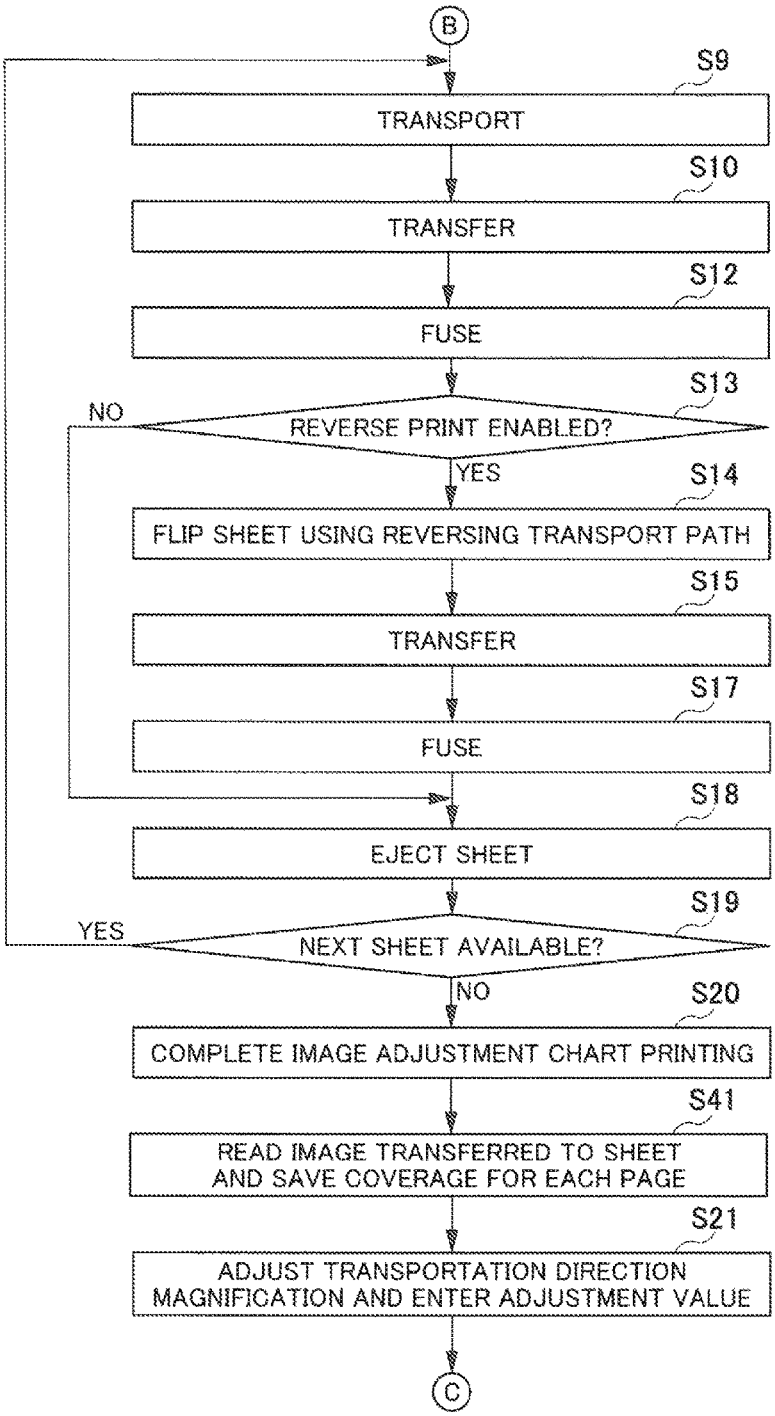
FIG. 14 is a flowchart illustrating a process to print an image adjustment chart and adjust the transportation direction magnification performed in the image forming apparatus according to the second embodiment of the present invention.

FIG. 14 is a flowchart illustrating a process to print an image adjustment chart and adjust the transportation direction magnification performed in the image forming apparatus 1A. The image forming system 10 uses the process to select the image adjustment chart illustrated in FIG. 10 and the process to select the image adjustment chart illustrated in FIG. 12 according to the above-mentioned first embodiment without change. Therefore, FIG. 14 uses the flowchart that is a modification of the process to print the image adjustment chart and adjust the transportation direction magnification illustrated in FIG. 11.

The flowchart in FIG. 14 excludes the process to read an image transferred to the surface of sheet S (S11) and the process to read an image transferred to the reverse of sheet S (S16) from the flowchart illustrated in FIG. 11. Instead, the flowchart in FIG. 14 includes an additional process (S41) after the image adjustment chart printing is complete (S20). In S41, the reading apparatus 2 reads an image printed on sheet S and saves the coverage for each page in the coverage adjustment value table 36*a* of the correspondence table 36. The subsequent process is similar to the process according to the first embodiment.

In the above-mentioned image forming system 10 according to the second embodiment, the reading apparatus 2 connected to the image forming apparatus 1A reads an image printed on sheet S and is capable of saving the coverage calculated for each page or job in the coverage adjustment value table 36*a* of the correspondence table 36. Even though excluding the reader 58 according to the first embodiment, the image forming apparatus 1A can acquire the coverage for each page or job just by connecting the reading apparatus 2. The process after acquiring the coverage is similar to the first embodiment. Namely, the adjustment value determiner 34 references the correspondence table 36 to settle an appropriate transportation direction magnification adjustment value and is capable of issuing a directive to adjust the transportation direction magnification for an image formed by the image former 40. The image former 40 can, therefore, form images on sheet S based on the transportation direction magnification settled in accordance with job conditions.

The above-mentioned reader 58 according to the first embodiment may be provided inside the image forming apparatus 1A downstream of the fuser 60 in the transportation direction. The adjustment value determiner 34 can acquire the coverage calculated by the reader 58 without providing the reading apparatus 2 posterior to the image forming apparatus 1A. The image forming apparatus 1A can be configured without the reading apparatus 2.

According to the above-mentioned embodiments, the transportation direction magnification for images is adjusted in detail based on the image adjustment chart transferred to the sheet and the job condition of the job to be executed currently. It is possible to suppress variations in the transportation direction magnification for images formed on sheets on a job basis, thus improving the print quality.

The present invention is not limited to the above-mentioned embodiments. It is further understood by those skilled in the art that various applications and modifications may be made in the present invention without departing from the spirit and scope thereof described in the appended claims.

For example, the above-mentioned embodiments describe, in detail and specifically, configurations of the apparatuses and the system in order to explain the present invention for simplicity but are not limited to an entity including all the configurations that have been described. The configuration of one of the above-mentioned embodiments can be partially replaced by the configuration of another embodiment. The configuration of one embodiment can be added to the configuration of another embodiment. The configuration of each embodiment can be partially subject to addition, deletion, or replacement of another configuration.

The control lines or the information lines are provided on condition that they are considered necessary for the sake of description. The description does not cover all control lines or information lines as products. Actually, almost all the configurations can be connected to each other.

Although embodiments of the present invention have been described and illustrated in detail, the disclosed embodiments are made for purposes of illustration and example only and not limitation. The scope of the present invention should be interpreted by terms of the appended claims.

REFERENCE SIGNS LIST

1 . . . image forming apparatus, 11 . . . controller, 21 . . . manipulation display, 31 . . . job inputter, 32 . . . chart determiner, 33 . . . chart utilizer, 34 . . . adjustment value determiner, 35 . . . chart storage, 36 . . . correspondence table, 40 . . . image former, 48 . . . secondary transferrer, 50 . . . paper transporter, 51 . . . paper feeder, 53 . . . main transport path, 58 . . . reader, 60 . . . fuser

What is claimed is:

1. An image forming apparatus comprising:

a transporter that transports a sheet;

an image former that forms an image;

a transferrer that is provided downstream of the image former along a transportation direction in which the transporter transports the sheet and transfers the image formed by the image former to the sheet; and a controller that selects an image adjustment chart used to adjust a transportation direction magnification for the image varying in the transportation direction and adjusts the transportation direction magnification for the image formed by the image former based on the image adjustment chart and a job condition of a job to be executed currently, the image adjustment chart being formed by the image former and transferred to the sheet by the transferrer.

2. The image forming apparatus according to claim 1, wherein the job condition includes at least one of a coverage for the image transferred to the sheet by the transferrer, a paper type of the sheet, and an environment to form the image on the sheet.

3. The image forming apparatus according to claim 2, wherein the controller includes:

a chart determiner that determines whether a job image included in the job is usable as the image adjustment chart; and a chart utilizer that allows the image former to form the job image determined by the chart determiner to be usable as the image adjustment chart.

4. The image forming apparatus according to claim 3, wherein the chart determiner determines the job image to be usable as the image adjustment chart when the job image includes at least two color boundaries in a direction orthogonal to the transportation direction and allows the color boundary to intersect a straight line parallel to the transportation direction.

5. The image forming apparatus according to claim 3, wherein the controller further includes a chart storage that stores an existing image adjustment chart; and wherein, when the chart determiner determines that the job image is unusable as the image adjustment chart, the chart utilizer reads the existing image adjustment chart from the chart storage and allows the image former to form the job image supplemented with the existing image adjustment chart.

6. The image forming apparatus according to claim 5, wherein the existing image adjustment chart includes at least one of a register-mark chart formed at each of four corners of the sheet and a grid-shaped chart including four intersecting straight lines formed along edges of the sheet.

7. The image forming apparatus according to claim 3, wherein the controller further includes:

an adjustment value determiner that determines an adjustment value for the transportation direction magnification based on the coverage for the image transferred to the sheet; and a correspondence table that maintains a correspondence relationship between the coverage and the transportation direction magnification adjustment value.

8. The image forming apparatus according to claim 7, wherein the adjustment value determiner allows the correspondence table to store a relationship between the coverage and the transportation direction magnification adjustment value and determines the transportation direction magnification adjustment value based on the coverage for the job image formed on the sheet in accordance with execution of the job.

9. The image forming apparatus according to claim 8, wherein the controller further includes a chart storage that stores an existing image adjustment chart; and wherein the adjustment value determiner adds a solid-color image as the existing image adjustment chart to the chart storage, the solid-color image being represented by an average of the coverage calculated based on a tail threading achievement indicative of the actual number of ejected sheets.

10. The image forming apparatus according to claim 7, wherein the adjustment value determiner uses the correspondence table to save an adjustment value used to adjust the transportation direction magnification at the first execution timing to execute the job and reuses the adjustment value read from the correspondence table when the currently executed job is equal to the already executed job and the environment for the job to be executed currently is equal to the environment for the already executed job.

11. The image forming apparatus according to claim 2, further comprising:

a reader that is provided downstream of the transferrer, reads the image transferred to the sheet by the transferrer, and calculates the coverage for the image transferred to the sheet.

12. The image forming apparatus according to claim 2, further comprising:

a fuser that is provided downstream of the transferrer and fuses the image transferred to the sheet; and a reader that reads the image fused onto the sheet by the fuser and calculates the coverage for the image on the sheet.

* * * * *